US006746551B2

(12) United States Patent
Sakaguchi et al.

(10) Patent No.: US 6,746,551 B2
(45) Date of Patent: Jun. 8, 2004

(54) MAKE BREAK CONTACT MATERIAL COMPRISING AG-NI BASED ALLOY HAVING NI METAL PARTICLES DISPERSED AND RELAY USING THE SAME

(75) Inventors: Osamu Sakaguchi, Kanagawa (JP); Kengo Taneichi, Kanagawa (JP); Toshiya Yamamoto, Kanagawa (JP)

(73) Assignee: Tanaka Kikinzoku Kogyo K.K., Tokyo (JP)

( * ) Notice: Subject to any disclaimer, the term of this patent is extended or adjusted under 35 U.S.C. 154(b) by 0 days.

(21) Appl. No.: 10/070,419

(22) PCT Filed: Jul. 18, 2001

(86) PCT No.: PCT/JP01/06219

§ 371 (c)(1),
(2), (4) Date: Mar. 15, 2002

(87) PCT Pub. No.: WO02/08481

PCT Pub. Date: Jan. 31, 2002

(65) Prior Publication Data

US 2002/0189720 A1 Dec. 19, 2002

(30) Foreign Application Priority Data

Jul. 21, 2000 (JP) ..... 2000-220360

(51) Int. Cl.[7] ..... C22C 5/06
(52) U.S. Cl. ..... 148/431; 420/501; 75/247
(58) Field of Search ..... 420/501, 502, 420/503, 504, 505, 506; 75/247; 148/431

(56) References Cited

U.S. PATENT DOCUMENTS 4,502,899 A 3/1985 Tsuji et al.
2003/0061903 A1 * 4/2003 Nakamura et al. ..... 75/235

FOREIGN PATENT DOCUMENTS

| | | |
|---|---|---|
| JP | A-52-13689 | 2/1977 |
| JP | A-56-81649 | 7/1981 |
| JP | A-58-93849 | 6/1983 |
| JP | A-61-246337 | 11/1986 |
| JP | A-3-71522 | 3/1991 |

* cited by examiner

*Primary Examiner*—George Wyszomierski
*Assistant Examiner*—Janelle Combs Morillo
(74) *Attorney, Agent, or Firm*—Rothwell, Figg, Ernst & Manbeck, P.C.

(57) ABSTRACT

A make-and-break contact material which is less worn out and is able to achieve an increased life compared to a conventional material of Ag—CdO-based alloy, in an AC general relay used for a resistive load of about 1 to 20A in a range of AC 100V to 250V. In the present invention, the make-and-break contact material of Ag—Ni-based alloy used for a switching part performing electrical switching through mechanical switching operation is the make-and-break contact material of Ag—Ni-based alloy with Ni metal particles dispersed therein which is obtained through mixing and stirring 3.1 to 20.0 wt % of Ni powder, a certain amount of $Li_2CO_3$ powder corresponding to 0.01 to 0.50 wt % of metal Li as an additive, and a balance being Ag powder to make a mixture with the above described powders uniformly dispersed therein, and through compacting and sintering the above described mixture.

9 Claims, 2 Drawing Sheets

MAKE BREAK CONTACT MATERIAL COMPRISING AG-NI BASED ALLOY HAVING NI METAL PARTICLES DISPERSED AND RELAY USING THE SAME

This application is a national stage entry of International Application No. PCT/JP01/06219, filed Jul. 18, 2001 designating the U.S., which claims the benefit of Japanese Application No. 2000-220360, filed Jul. 21, 2000.

BACKGROUND OF THE INVENTION

1. Field of the Invention

The present invention relates to increasing durability of an AC general relay and specifically, in the AC general relay used for a resistive load of about 1 to 20A in the range of AC 100V to 250V, to a make-and-break contact material of Ag—Ni-based alloy with Ni metal particles dispersed therein having excellent endurance compared to a conventional make-and-break contact material of Ag—CdO-based alloy and to a relay using the same.

2. Earlier Technology

An electric contactor which is used for a switching part performing electrical switching through mechanical switching motion is generally called an electric contact. The electric contact requires to transmit a current and signals passing through the contact without any trouble by metal-to-metal contact and to allow itself to be in an open position without any trouble when the metal-to-metal contact is disengaged.

The electric contact has a simple structure, however, it has become common-sense that various physical or chemical phenomena occur on a surface of the contact. The phenomena include, for example, adsorption, oxidation, sulfurization, synthesis of organic compounds, and further, melting, evaporation, ablation, and conversion which entail discharge. These phenomena are significantly complicated and have not yet academically clarified in many parts, and are greatly attributed to the quality of the electric contact material.

Upon occurring these phenomena, a contact function of an electric contact is somewhat disrupted and in some cases the contact function is completely disrupted (e.g., welding), which determines performance and useful life of an electrical appliance incorporating the electric contact. This means that the electric contact is one of the important parts which determine the useful life and performance of the electrical appliances or the like.

In recent years with the significant advancement of electronics and electrical engineering, the scope of application of the electric contact widely varies from an electronic field including a telegraph and telephone and other various electronic equipment to an electric field including electric equipment which interrupts a large current. Therefore, functions to be required vary widely, so that the development of the electric contacts having characteristics adapted to their respective uses is now in progress, and great many kinds of electric contacts are supplied to the market.

In such an electric contact, the technical common-sense having been conventionally known of the AC general relay or switch which is a subject matter of the present invention is as follows. That is, the electric contactor incorporated in the relay or switch is a so-called make-and-break contact. An electric contact material used for this make-and-break contact is in particular required to have wear resistance and transition resistance in order to maintain a stable mechanism and low contact resistivity in order to maintain a stable contact state.

Make-and-break contact materials used for the AC general relays or the like, which are traditionally well known, include an Ag—CdO-based alloy (an alloy comprised of 10 to 15 wt % CdO and a balance being Ag) or the like.

Although each of these electric contact materials may be used alone without being processed, the material may frequently be used after being processed into a two or three layered-type of clad rivet contact in which this material is laminated on Cu or a Cu alloy as a primer or into a two to five layered-type of clad crossbar contact in which this material is laminated on Cu or a Cu alloy as a primer. This clad rivet contact or clad crossbar contact is used being incorporated in the relays, in which electric signals applied in a form of a direct current, an alternating current, or electric impulses generate a coil magnetic flux, and the magnetic force attracts a moving iron, then the electric contact performs switching operations responding to the motion of the moving iron.

This conventional Ag—CdO-based make-and-break contact material satisfies the wear resistance, the transition resistance, and the low contact resistivity at practical levels when using the alternating current load ranging from AC 100 V to 250 V, however, it has been newly pointed out that this material has following problems.

First of all, the conventional make-and-break contact material is not a material adapted to a requirement of a miniaturization. With the enhancement of the functions and performances of the household electrical appliances, the numbers of electric parts to be mounted increase and the miniaturization of the parts themselves is further proceeding. Thus, in spite of being desired to achieve the miniaturization of the relays or switches themselves in consideration of the cost, the conventional make-and-break contact materials cannot sufficiently address the miniaturization.

In other words, if a volume of the make-and-break contact material becomes smaller in order to achieve the miniaturization of the relays, the work load per unit volume of the material largely increases at the time of conduction and interruption of the current, and consequently, the conventional material itself is rapidly worn out, then the failures occur at early stage.

SUMMARY OF THE INVENTION

The present invention is developed against the background of the above described circumstances and to provide a make-and-break contact material which is able to achieve the less wear and to-increase the useful life of the AC general relays even when the miniaturization is achieved, compared with a conventional Ag—CdO-based material.

The inventors have devoted themselves to this development in order to solve above described problems and finally found a make-and-break contact material of Ag—Ni-based alloy with Ni metal particles dispersed therein as follows. That is the make-and-break contact material of Ag—Ni-based alloy which is used for a switching part performing electrical switching through mechanical switching motion, wherein the material with Ni metal particles dispersed therein is obtained by mixing and stirring 3.1 to 20.0 wt % of Ni powder, a certain amount of $Li_2CO_3$ powder corresponding to 0.01 to 0.50 wt % of metal Li as an additive, and a balance being Ag powder to form a mixture with the above described powders uniformly dispersed therein, and by subjecting the above described mixture to a compacting process and to a sintering process.

The make-and-break contact material of the present invention is an Ag—Ni-based alloy with Ni metal particles dispersed in an Ag matrix and with $Li_2CO_3$ dispersed therein. According to the make-and-break contact material of Ag—Ni-based alloy with Ni metal particles dispersed therein of the present invention, wear resistance, transition resistance, and low contact resistivity are maintained at practical levels in case of an AC load of 1 to 20A in a range from AC 100V to 250V, even when a volume of the make-and-break contact material itself becomes smaller. Consequently, it becomes possible to achieve long-term usage, i.e. the increase in its useful life.

Ni in the make-and-break contact material of Ag—Ni-based alloy with Ni metal particles dispersed therein according to the present invention exists as Ni metal particles in the Ag matrix and contributes to improvement of wear resistance when the material is used for an AC general relay in the range from AC 100V to 250V and from 1 to 20A. When the amount of Ni is less than 3.1 wt %, it becomes difficult to maintain wear resistance of the AC general relay to the practical level, while the amount of Ni exceeds 20.0 wt %, then the problems associated with manufacturing the contacts such as reduction in stability of contact resistance and in workability will occur. In the case of using this material for the AC general relay, it is optimum that the Ni powder in the make-and-break contact material of Ag—Ni-based alloy with Ni metal particles dispersed therein according to the present invention is 8.0 to 15.0 wt %.

$Li_2CO_3$ also exists as particles in the Ag matrix as in the case of Ni metal particles, and in an application for the AC general relays used in the range from AC 100V to 250V and from 1 to 20A, the present material exhibits arc extinguishing action similar as that of the conventional CdO and contributes to improvement of wear resistance. However, when the metal Li is less than 0.00 wt %, the effect of $Li_2CO_3$ cannot be recognized, while the metal Li exceeds 0.50 wt %, the stability of contact resistance is reduced and the sintering property of the material is also degraded. Thus, it becomes difficult to manufacture this product. When using this material for the AC general relays, $Li_2CO_3$ powder in the make-and-break contact material of Ag—Ni-based alloy with Ni metal particles dispersed therein according to the present invention is optimally exists in the amount of 0.05 to 0.2 wt % on a metal Li basis.

When constituting the relay using the make-and-break contact material of Ag—Ni-based alloy with Ni metal particles dispersed therein according to the present invention, miniaturization of the relay is achieved and wear resistance, transition resistance, and low contact resistivity are maintained at practical levels in case of using the AC load in a range from AC 100V to 250 v and from 1 to 20A. Therefore, it becomes possible to achieve long-term usage, i.e. the increase in its useful life.

PREFERRED EMBODIMENTS

An embodiment of the present invention will be explained with reference to the examples described below. Example 1 described in Table 1 is a make-and-break contact material of Ag—Ni-based alloy with Ni metal particles dispersed therein according to the present invention, Conventional Example 1 is a conventional make-and-break contact material of Ag—Ni-based alloy, and Comparative Example 1 is a make-and-break material mainly used for a general relay.

TABLE 1

| | Ag powder | Ni powder | $Li_2CO_3$ powder being added (as metal Li) |
|---|---|---|---|
| Example 1 | Balance | 10.0 | 0.1 |
| Conventional Example 1 | Balance | 10.0 | — |
| | Ag | CdO | |
| Comparative Example 1 | Balance | 12.0 | |

The make-and-break contact material of Ag—Ni-based alloy with Ni metal particles dispersed therein according to Example 1 was made into a cylindrical powder compact by mixing 10.0 wt % of Ni powder, a certain amount of $Li_2CO_3$ powder corresponding to 0.1 wt % of metal Li as an additive, and a balance being Ag powder, stirring this powder mixture for four hours in a ball mill to make the mixture uniform, then loading the mixture within a cylindrical vessel, and applying pressure to this mixture in a longitudinal direction of the cylindrical vessel. Following this compression process, a sintering process was carried out for four hours at 1123K (850° C.). These compression process and sintering process were repeated four times. A billet subjected to the compression process and sintering process was formed into a wire having a diameter of 6.0 mm through hot extrusion. Subsequently, the wire was subjected to wire drawing to have a diameter of 2.3 mm. Then the 2.3 mm-diameter wire was-made into a rivet contact having a head diameter of 3.5 mm and a head thickness of 1 mm using a header machine.

In Conventional Example 1, a rivet contact was also made by the same process as that in Example 1, except for adding $Li_2CO_3$.

On the other hand, Comparative Example 1 was about a make-and-break contact material formed by the so-called internal oxidation process, which is currently and mainly used for a general relay. A wire was made from this material, and a rivet contact having a head diameter of 3.5 mm and a head thickness of 1 mm was made by a header machine as described in Example 1 and Conventional Example 1.

Figure 1:
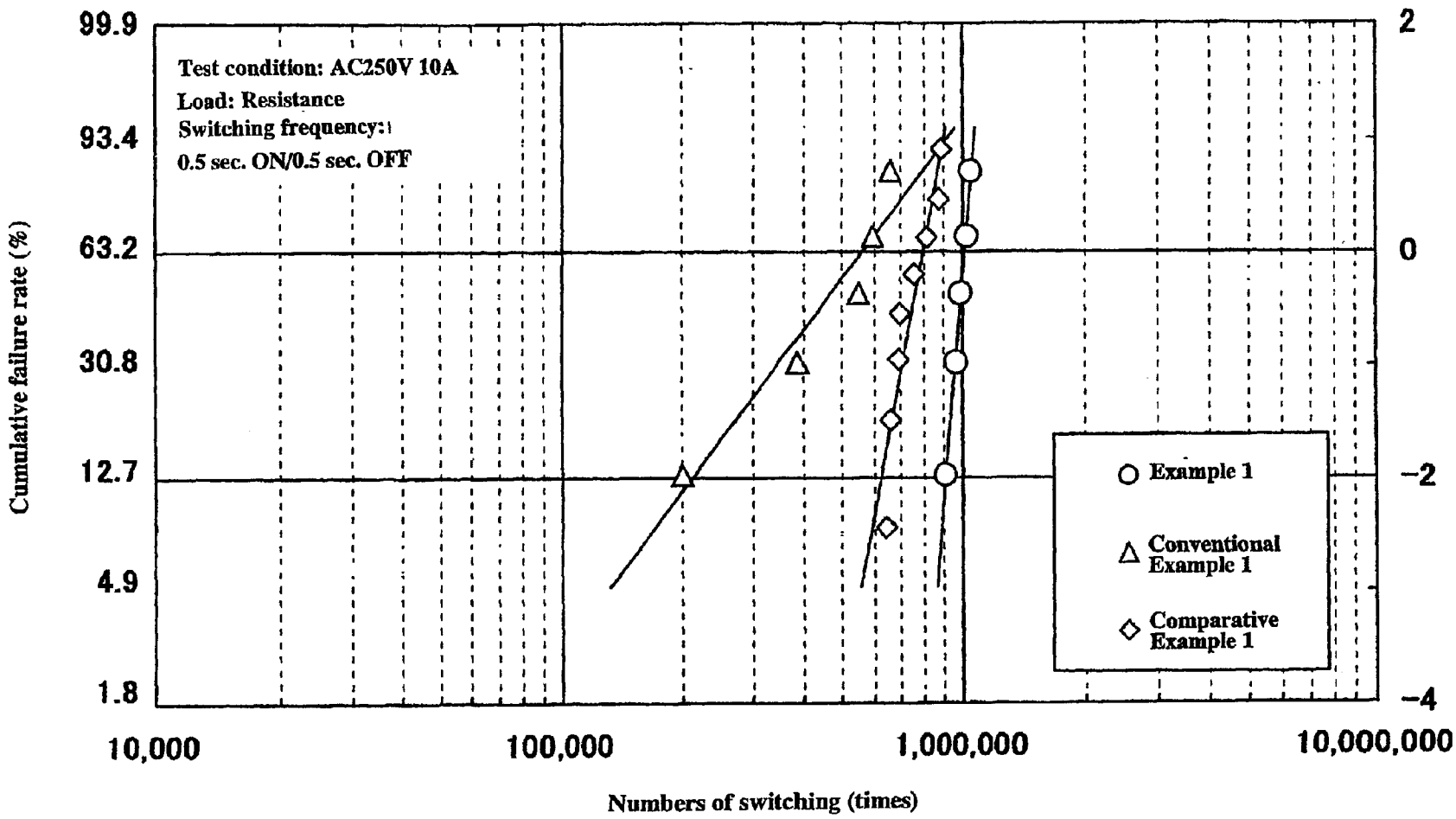
FIG. 1 is a graph showing the data obtained from endurance tests are plotted on a Weibull probability paper.

Each rivet contact was incorporated into the AC general relay and an endurance test was performed in accordance with the conditions described in Table 2. This endurance test was performed using five or more relays, the numbers of switching until respective relays fail (service life) are shown in Table 3 and each result which is represented on a Weibull probability paper is shown in FIG. 1. In addition, Table 4 shows characteristic life values, m-values, and the numbers of switching at 5% of cumulative failure rate, all of which are read from the Weibull probability paper.

TABLE 2

| | |
|---|---|
| Voltage | AC 250 V |
| Current | 10 A |
| Load | Resistance |
| Switching frequency | 1.0 sec. ON/2.0 sec. OFF |
| Contact force | $4.41 \times 10^{-1}$N (45 gf) |
| Opening force | $4.41 \times 10^{-1}$N (45 gf) |
| Ambient temperature | Ordinary temperature |

TABLE 3

| | Example 1 | Conventional Example 1 | Comparative Example 1 |
|---|---|---|---|
| Numbers of switching during service life | 905,126 | 199,652 | 643,165 |
| | 963,843 | 387,089 | 659,002 |
| | 986,753 | 548,444 | 690,004 |
| | 1,020,587 | 594,609 | 694,700 |
| | 1,044,980 | 657,233 | 753,545 |
| | — | — | 810,871 |
| | — | — | 870,051 |
| | — | — | 881,826 |

TABLE 4

| | Value of characteristic life | m-value | Numbers of switching at 5% of cumulative failure rate |
|---|---|---|---|
| Example 1 | 1,009,336 | 18.6 | 860,397 |
| Conventional Example 1 | 599,027 | 2.1 | 132,004 |
| Comparative Example 1 | 793,053 | 8.3 | 554,128 |

According to the result of endurance test shown in Table 3, the make-and-break contact material of Ag—Ni-based alloy from this Example 1 was verified that the material had an service life of 900,000 times or more of switching when using a resistive load of 10A at AC 250 V. Conventional Example 1 shows that the first relay failed when the numbers of switching reached to about 200,000, so that an effect of adding $Li_2CO_3$ described in the present invention was verified. On the other hand, the first relay from Comparative Example 1 failed when the numbers of switching reached to 640,000. Therefore, it was also verified that the relay from Example 1 had a longer service life than that of the relay from Comparative Example 1 which had currently become a standard of the AC general applications, so that the material from Example 1 was excellent.

As can be seen from comparing respective data with each other which are read from the Weibull probability paper shown in Table 4, it has been found that the relay from Example 1 has a large characteristic life value and a large m-value, so that this relay is excellent in its useful life characteristic and is stable without variations in a failure probability. As for the numbers of switching at 5% of cumulative failure rate, the relay from Example 1 has the largest value, so that this relay is found to have practically excellent endurance.

A result of investigating the wear resistance according to ASTM test is now described. This ASTM test is performed by using the rivet contact described above, carrying out switching operation in accordance with the conditions described in Table 5, and then measuring a decreasing weight of the contact as an amount to have been worn out. The result is described in FIG. 2.

TABLE 5

| | |
|---|---|
| Test voltage | AC 250 V |
| Test current | 10 A |
| Load | Resistance |
| Switching frequency | 0.5 sec. ON/0.5 sec. OFF |
| Contact force | $8.33 \times 10^{-1}$N (85 gf) |
| Opening force | $8.33 \times 10^{-1}$N (85 gf) |
| Numbers of switching | 150,000 times |

Figure 2:
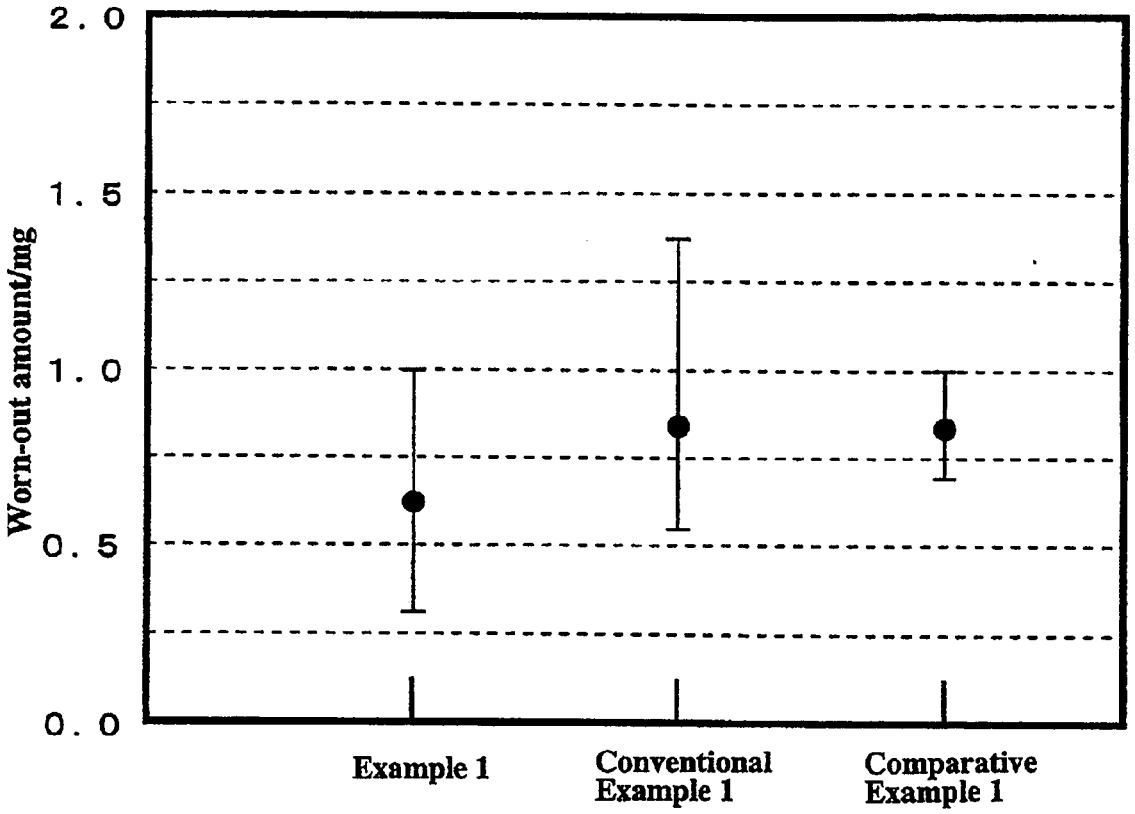
FIG. 2 is a graph showing investigation results on wear resistance according to ASTM tests.

As shown in FIG. 2, a worn-out amount in Example 1 was 0.620 mg on average, while the worn-out amount in Conventional Example 1 was 0.846 mg on average, and the worn-out amount in Comparative Example 1 was 0.894 mg on average, so that it has been verified that the relay from Example 1 is definitely excellent in the wear resistance.

As for the make-and-break contact material of Ag—Ni-based alloy with Ni metal particles dispersed therein according to the present invention, it has been verified that an breakthrough improvement has been recognized in a resistive load of an AC general relay, the useful life as the AC general relay can be significantly increased. These improvements allow the above described material to respond to the further miniaturization of the AC general relays and to the increase in its useful life of the relays.

What is claimed is:

1. A make-and-break contact material comprising an Ag—Ni-based alloy comprising 3.1 to 20.0 wt % of Ni, $Li_2CO_3$ in an amount corresponding to 0.01 to 0.50 wt % of Li metal, and a balance of Ag.

2. A relay comprising the make-and-break contact material of claim 1.

3. A switching part comprising the make-and-break contact material of claim 1, wherein said switching part performs electrical switching through a mechanical switching operation.

4. A make-and-break contact material according to claim 1, wherein said contact material comprises 8.0–15.0 wt % of Ni.

5. A make-and-break contact material according to claim 1, wherein said contact material comprises $Li_2CO_3$ in an amount corresponding to 0.05 to 0.2 wt % of Li metal.

6. A make-and-break contact material according to claim 1, wherein said Ni powder is uniformly dispersed in said Ag-Ni-based alloy.

7. A make-and-break contact material according to claim 1, wherein said Ag powder is present in an amount that constitutes the balance of said alloy.

8. A make-and-break contact material according to claim 1, wherein said contact material is adapted to withstand at least 900,000 times or more of switching when using a resistive load of 10A at AC 250V.

9. A make-and-break contact material according to claim 8, wherein said contact material is part of a miniaturized make and break contact.

* * * * *